US012037791B2

(12) United States Patent
Hoke

(10) Patent No.: US 12,037,791 B2
(45) Date of Patent: Jul. 16, 2024

(54) GUTTER DEBRIS CHUTE ASSEMBLY

(71) Applicant: Fredrick Alan Hoke, Lincoln, NE (US)

(72) Inventor: Fredrick Alan Hoke, Lincoln, NE (US)

( * ) Notice: Subject to any disclaimer, the term of this patent is extended or adjusted under 35 U.S.C. 154(b) by 115 days.

(21) Appl. No.: 17/949,060

(22) Filed: Sep. 20, 2022

(65) Prior Publication Data

US 2024/0093498 A1 Mar. 21, 2024

(51) Int. Cl.
*E04D 13/064* (2006.01)

(52) U.S. Cl.
CPC ..... *E04D 13/0645* (2013.01)

(58) Field of Classification Search
CPC ..... E04D 13/0645
See application file for complete search history.

(56) References Cited

U.S. PATENT DOCUMENTS

| | | | | | |
|---|---|---|---|---|---|
| 3,994,055 | A * | 11/1976 | Maloney, Jr. | E04D 13/068 | 52/16 |
| 4,285,812 | A * | 8/1981 | Stoltz | E04D 13/0409 | 52/12 |
| 4,741,645 | A * | 5/1988 | Butler | E04D 13/0641 | 52/16 |
| 6,282,845 | B1 | 9/2001 | Hines | | |
| 7,913,458 | B2 | 3/2011 | Higginbotham | | |
| 8,286,390 | B2 * | 10/2012 | Leahy | E04D 13/0645 | 52/302.1 |
| 8,844,208 | B1 | 9/2014 | Feldhaus | | |
| 2006/0032152 | A1 | 2/2006 | Awad | | |
| 2012/0073212 | A1 | 3/2012 | Wootton | | |

FOREIGN PATENT DOCUMENTS

| | | | | |
|---|---|---|---|---|
| DE | 2155122 A1 * | 5/1973 | | |
| FR | 1468213 A * | 2/1967 | | |
| GB | 629220 A * | 9/1949 | | |
| GB | 2106156 A * | 4/1983 | E04D 13/0645 | |
| GB | 2221704 A * | 2/1990 | E04D 13/0645 | |
| GB | 2371312 A * | 7/2002 | E04D 13/0645 | |
| WO | WO2009146066 | 12/2009 | | |

* cited by examiner

*Primary Examiner* — Adriana Figueroa

(57) ABSTRACT

A gutter debris chute assembly includes a chute that has a pair of entries that is each attachable to a respective pair of gutters on a building to receive rain and debris from the gutters. The chute has an exit that is positioned between the entries. The exit is attachable to a downspout on the building to direct the rain and debris into the downspout. The chute curves downwardly between each of the entries and the exit thereby facilitating the chute to increase the velocity of the rain and debris when the rain and debris moves toward the exit. In this way the chute inhibits the debris from clogging in the chute. The chute has a plurality of vanes each is disposed in the chute and each of the vanes is oriented to surround the exit. Each of the vanes is curved thereby urging the rain and debris to flow in a circular direction to inhibit the debris from clogging in the downspout.

7 Claims, 7 Drawing Sheets

GUTTER DEBRIS CHUTE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to gutter devices and more particularly pertains to a new gutter device for inhibiting debris from clogging in a gutter and a downspout. The device includes a chute that has a pair of entries that each receives a respective one of a pair of gutters on a building for receiving rain and debris from the gutters. The device includes an exit that is attached to a downspout and a plurality of vanes in the exit. The chute is structured to increase the velocity of the rain and debris between the entries and the exit to inhibit the debris from clogging in the chute. Furthermore, the vanes impart a rotation into the rain and the debris to inhibit the rain and the debris from clogging in the downspout.

(2) Description of Related Art Including Information Disclosed Under 37 CFR 1.97 and 1.98

The prior art relates to gutter devices including a gutter liner that comprises a sheet of rigid material that fits independently in a gutter. The prior art discloses a gutter shield that includes a foraminous plate. The prior art discloses a rain catching device that includes a plurality of gutter screens that are positionable over a rain gutter. The prior art discloses a gutter system for reducing debris clutter that includes a series of curved tubes.

BRIEF SUMMARY OF THE INVENTION

An embodiment of the disclosure meets the needs presented above by generally comprising a chute that has a pair of entries that is each attachable to a respective pair of gutters on a building to receive rain and debris from the gutters. The chute has an exit that is positioned between the entries. The exit is attachable to a downspout on the building to direct the rain and debris into the downspout. The chute curves downwardly between each of the entries and the exit thereby facilitating the chute to increase the velocity of the rain and debris when the rain and debris moves toward the exit. In this way the chute inhibits the debris from clogging in the chute. The chute has a plurality of vanes each is disposed in the chute and each of the vanes is oriented to surround the exit. Each of the vanes is curved thereby urging the rain and debris to flow in a circular direction to inhibit the debris from clogging in the downspout.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
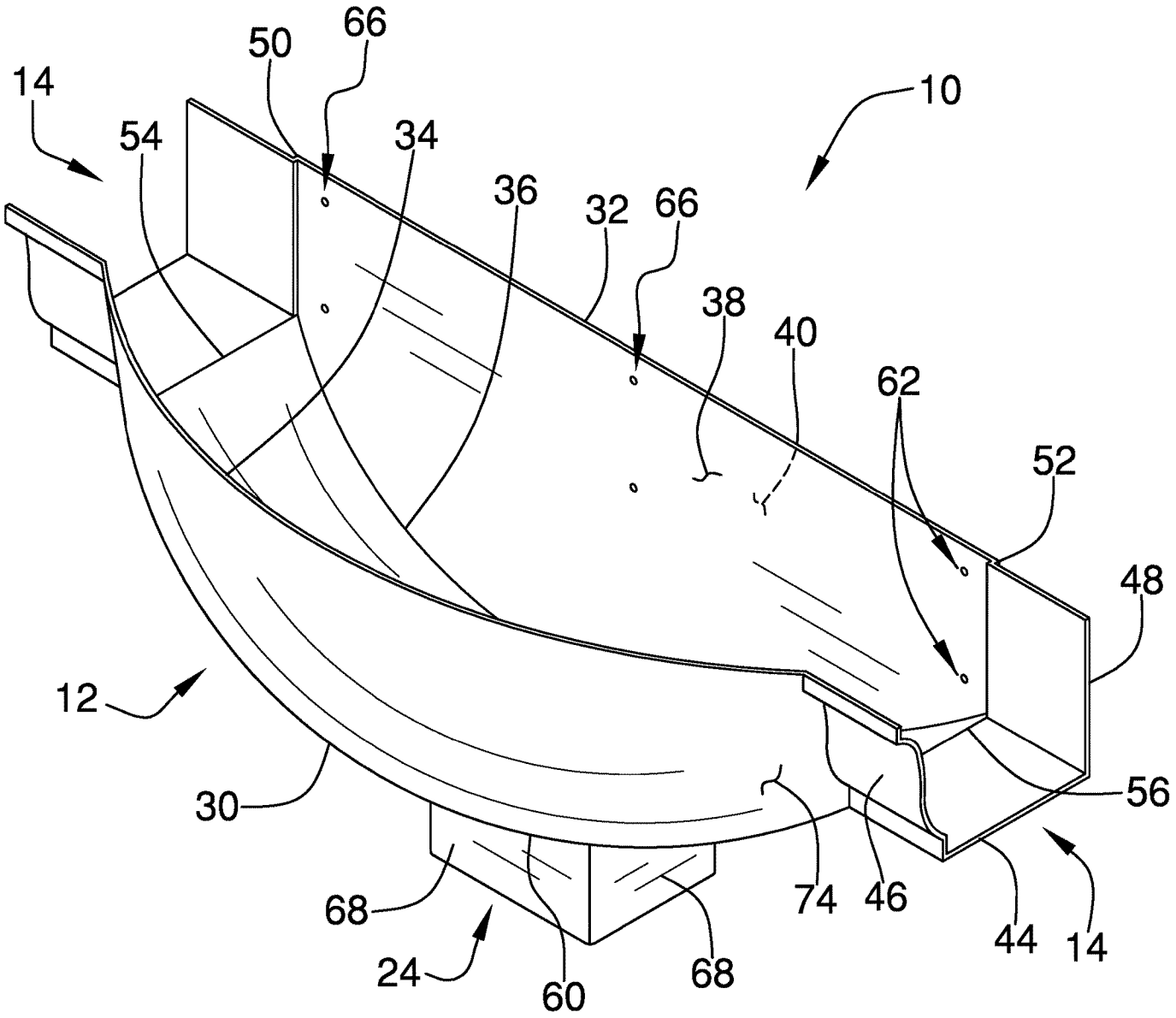
FIG. 1 is a top perspective view of a gutter debris chute assembly according to an embodiment of the disclosure.
Figure 2:
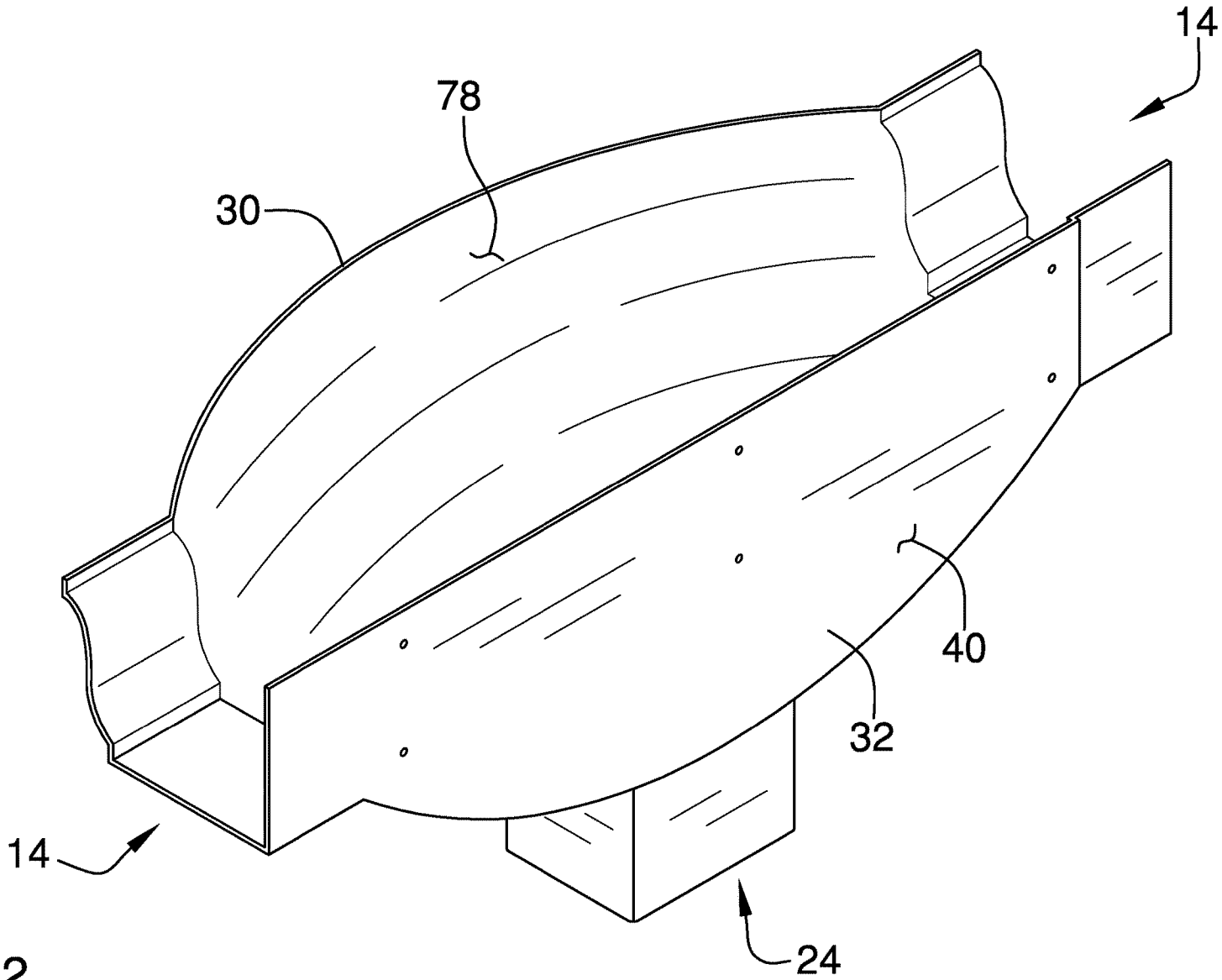
FIG. 2 is a back perspective view of an embodiment of the disclosure.
Figure 3:
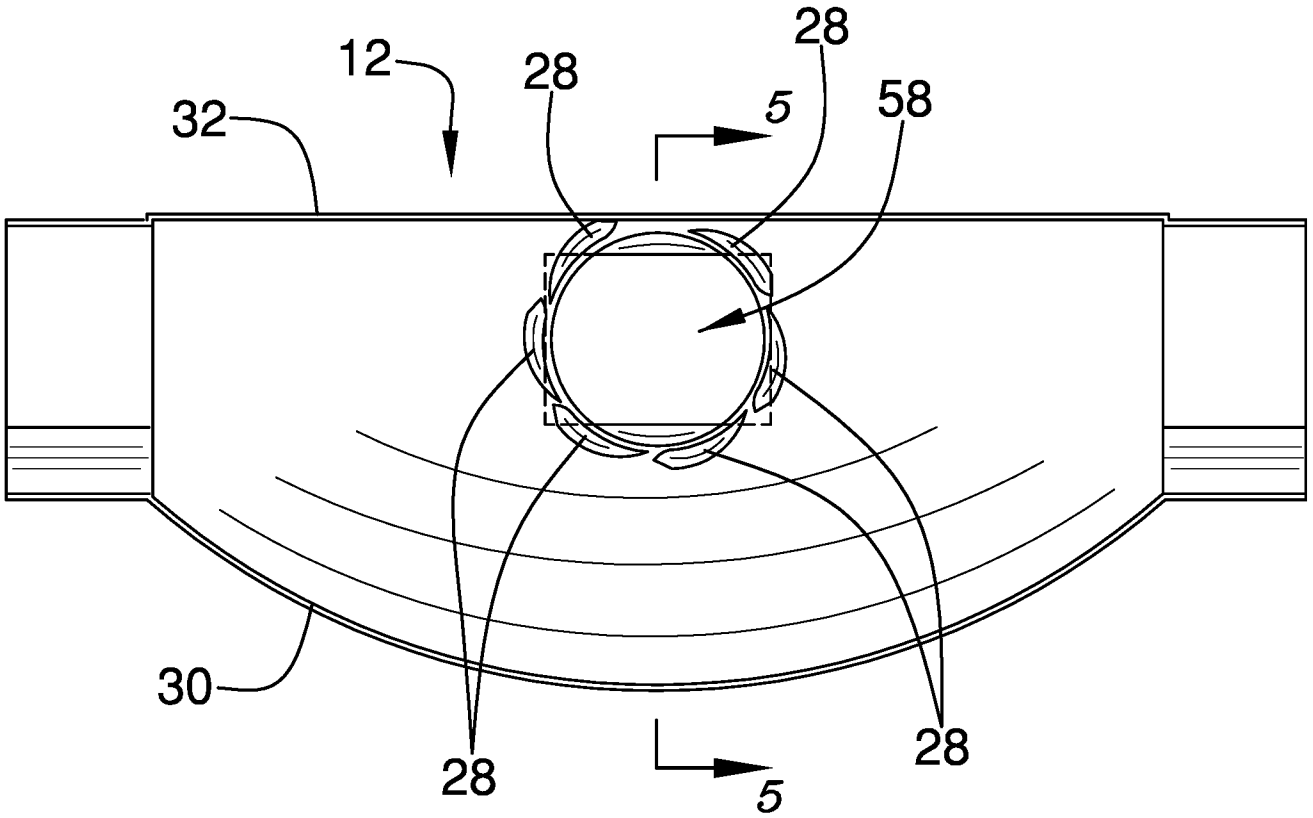
FIG. 3 is a top view of an embodiment of the disclosure.
Figure 4:
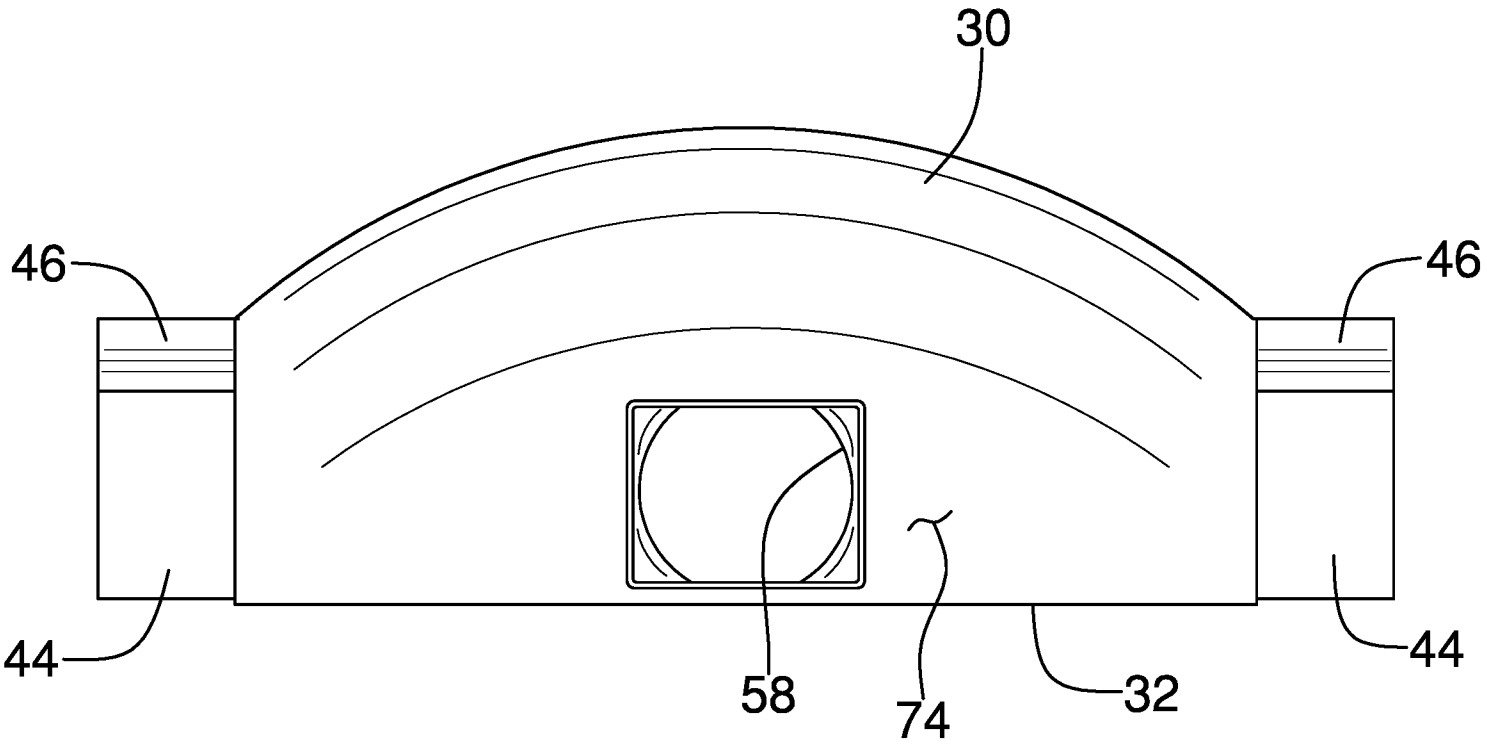
FIG. 4 is a bottom view of an embodiment of the disclosure.
Figure 5:
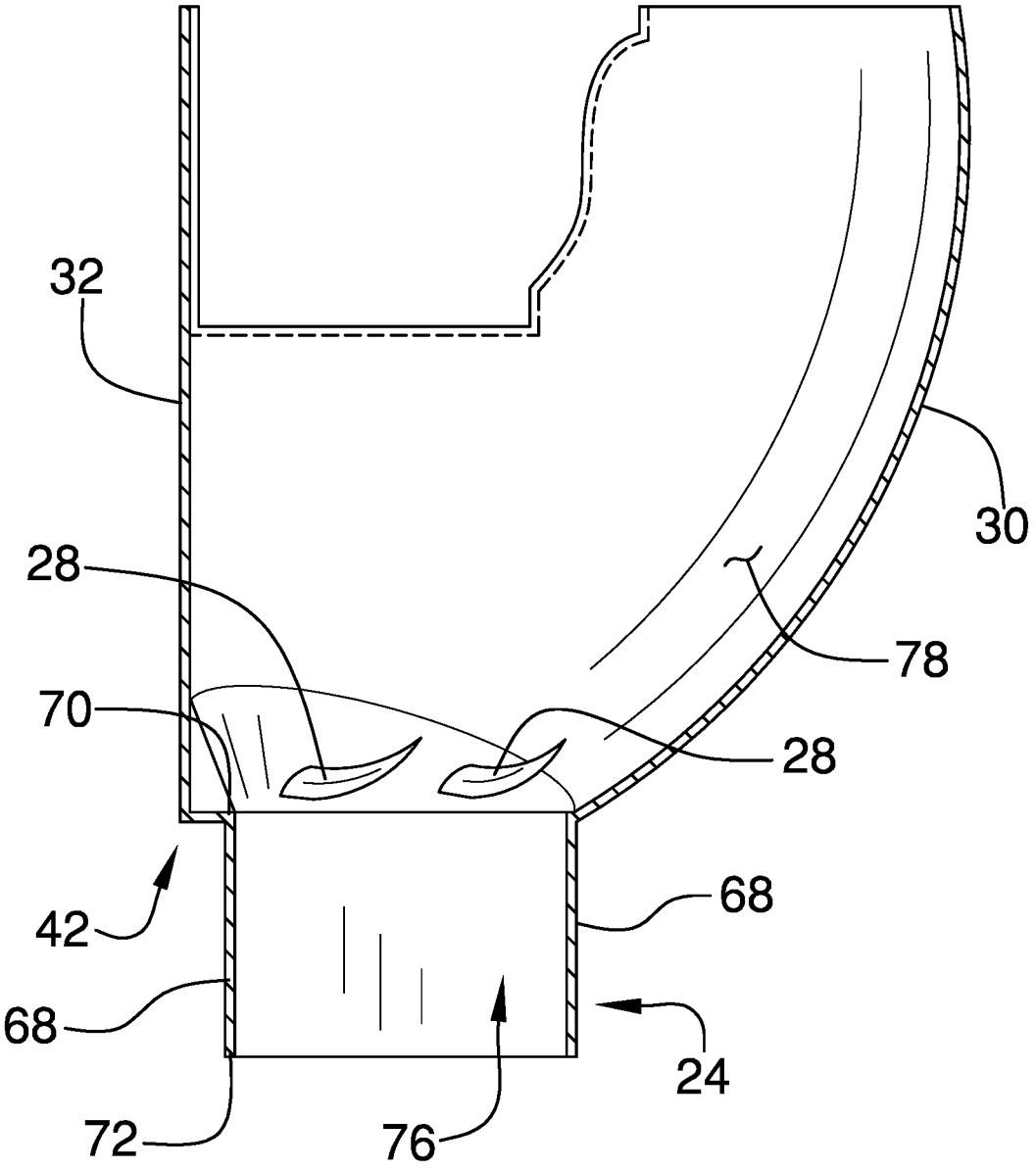
FIG. 5 is a cross sectional view taken along line 5-5 of FIG. 3 of an embodiment of the disclosure.
Figure 6:
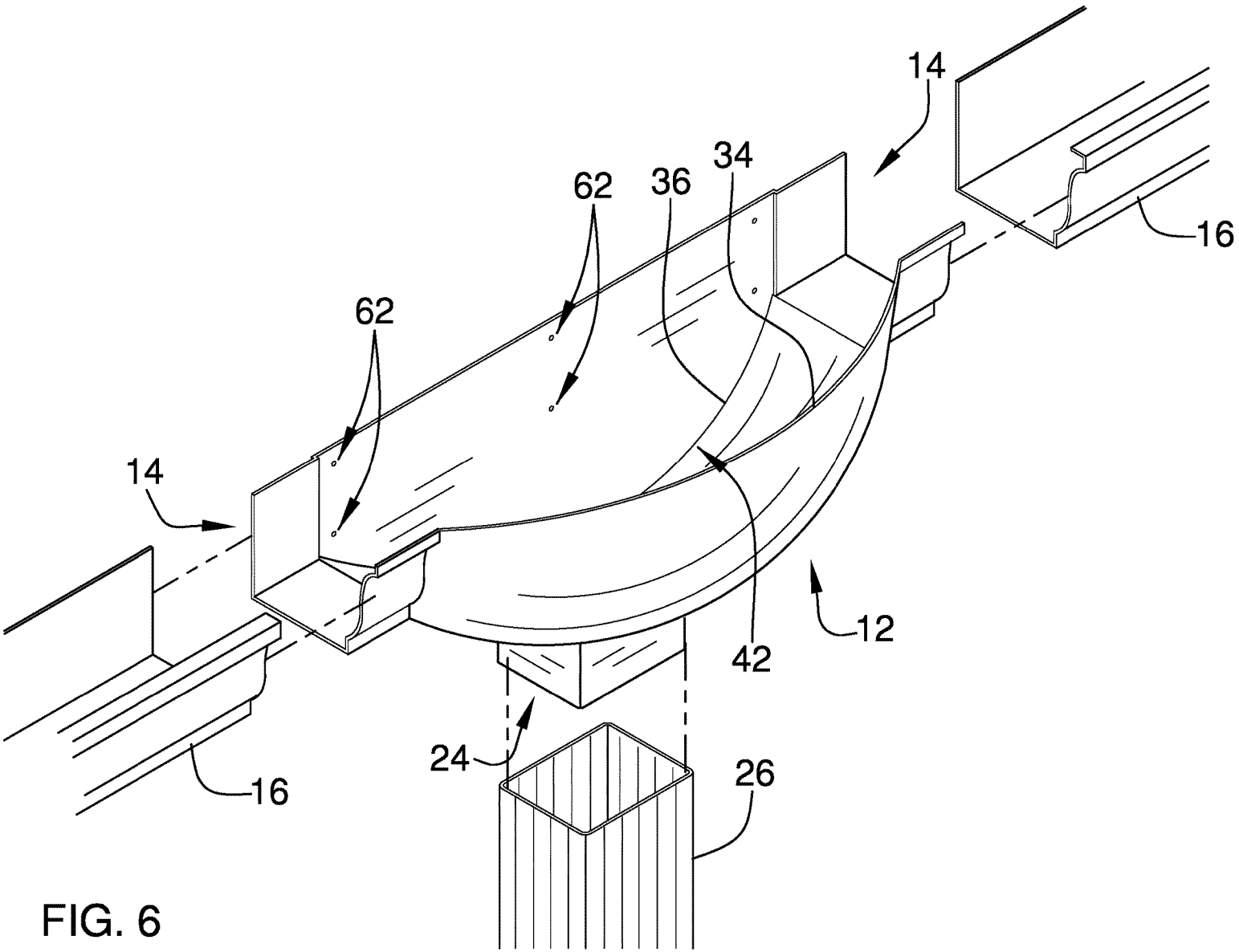
FIG. 6 is an exploded in-use view of an embodiment of the disclosure.
Figure 7:
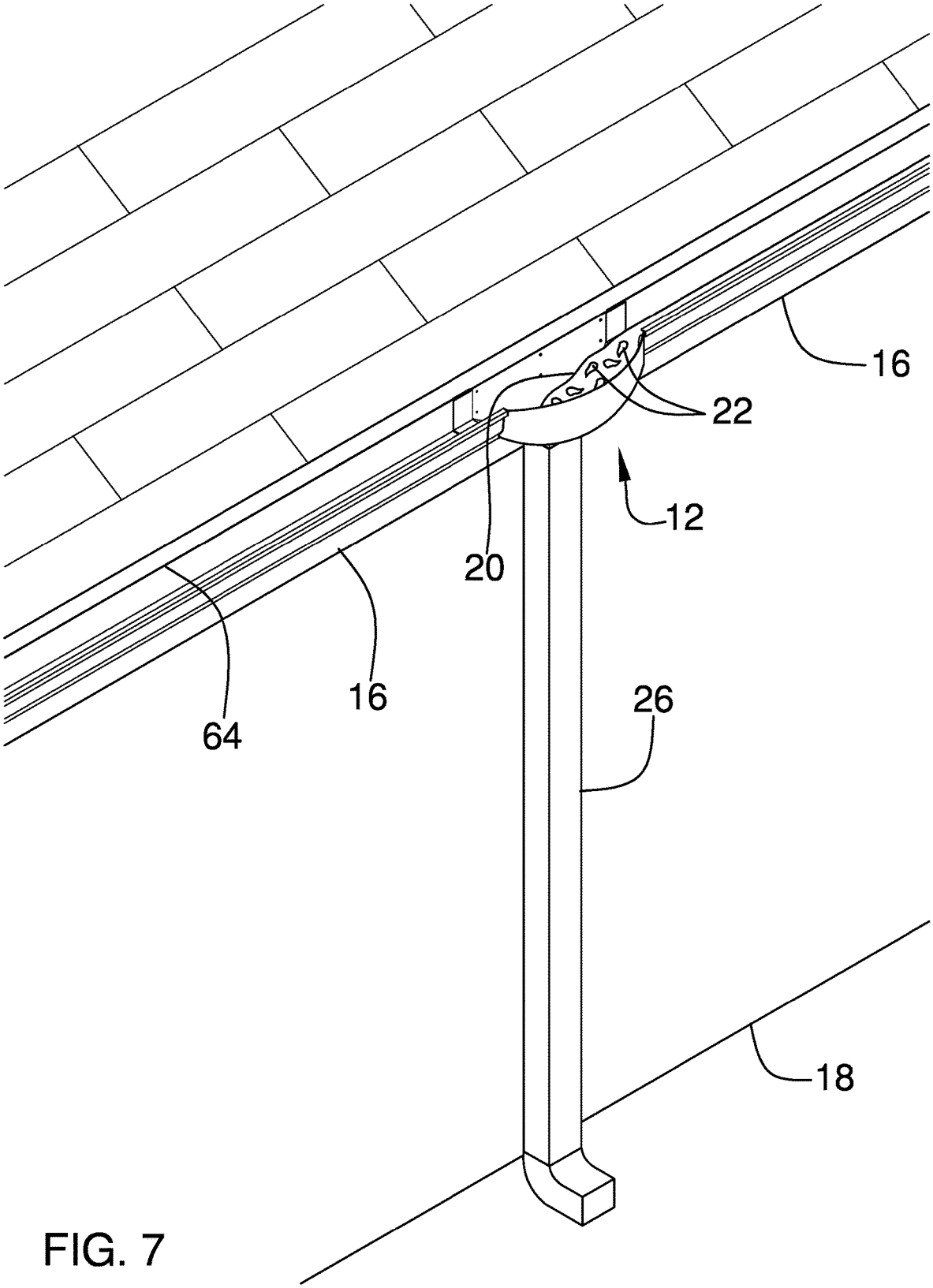
FIG. 7 is a perspective in-use view of an embodiment of the disclosure.

With reference now to the drawings, and in particular to FIGS. 1 through 7 thereof, a new gutter device embodying the principles and concepts of an embodiment of the disclosure and generally designated by the reference numeral 10 will be described.

As best illustrated in FIGS. 1 through 7, the gutter debris chute assembly 10 generally comprises a chute 12 that has a pair of entries 14 that is each attachable to a respective pair of gutters 16 on a building 18 to receive rain 20 and debris 22 from the gutters 16. The debris 22 may be leaves, sticks and other type of material that commonly gets washed into gutters 16. The building 18 may be a house, an office building or any other type of occupancy and the gutters 16 on the building 18 may be rain gutters of any conventional design. The chute 12 has an exit 24 positioned between the entries 14 and the exit 24 is attachable to a downspout 26 on the building 18 to direct the rain 20 and debris 22 into the downspout 26.

The chute 12 curves downwardly between each of the entries 14 and the exit 24 thereby facilitating the chute 12 to increase the velocity of the rain 20 and debris 22 when the rain 20 and debris 22 moves toward the exit 24 to inhibit the debris 22 from clogging in the chute 12. The chute 12 has a plurality of vanes 28 that is each disposed in the chute 12 and each of the vanes 28 is oriented to surround the exit 24. Each of the vanes 28 is curved thereby urging the rain 20 and debris 22 to flow in a circular direction to inhibit the debris 22 from clogging in the downspout 26.

The chute 12 has a first wall 30 and a second wall 32 and the first wall 30 has a top edge 34 and a rear edge 36. The first wall 30 curves outwardly between the top edge 34 and the rear edge 36 such that the first wall 30 defines a semi-spherical shape. The second wall 32 is planar and the second wall 32 has a front surface 38 and a rear surface 40. The rear edge 36 is attached to the front surface 38 of the second wall 32 such that the rear edge 36 defines a lower threshold 42 of the second wall 32.

Each of the entries 14 has a basal wall 44 extending between a front wall 46 and a rear wall 48. The rear wall 48 of each of the entries 14 is integrated into a respective one of a first lateral edge 50 and a second lateral edge 52 of the first wall 30 and the rear wall 48 of each of the entries 14 is offset from the second wall 32 toward the first wall 30. The basal wall 44 of each of the entries 14 is integrated into a respective one of a first lateral edge 54 and a second lateral edge 56 of the second wall 32. The front wall 46 of each of the entries 14 is integrated into a respective one of the first lateral edge 50 and the second lateral edge 52 of the first wall 30. Additionally, the front wall 46 may be structured with contours that conform to the structure of the gutters 16 and the front wall 46 may be manufactured in a variety of shapes to conform to a variety of gutter designs. The first wall 30 has an opening 58 extending through the first wall 30 to pass the rain 20 and debris 22 through the opening 58. The opening 58 is positioned adjacent to the second wall 32 and the opening 58 is aligned with an apex 60 of the first wall 30.

The second wall 32 has a plurality of holes 62 each extending through the front surface 38 and the rear surface 40 of the second wall 32 thereby facilitating each of the holes 62 to accommodate a fastener to fasten the second wall 32 to facia 64 of the building 18. The holes 62 are arranged into a plurality of columns 66 that are spaced apart from each other and are distributed between the first lateral edge 54 and the second lateral edge 56 of the second wall 32. The rear surface 40 of the second wall 32 rests against the facia 64 and the offset of the rear wall 48 of each of the entries 14 ensures that the entries 14 will be aligned with the respective gutter 16 when the chute 12 is mounted to the facia 64.

The exit 24 has a plurality of intersecting walls 68 such that the exit 24 has a rectangular shape. Each of the intersecting walls 68 has an upper edge 70 and a lower edge 72, and the upper edge 70 of each of the intersecting walls 68 is integrated into an outer surface 74 of the first wall 30. The exit 24 is aligned with the opening 58 in the first wall 30 and the opening 58 in the first wall 30 conforms to the upper edge 70 of each of the intersecting walls 68 of the exit 24. The lower edge 72 of each of the intersecting walls 68 defines an opening 76 into the exit 24 for insertably receiving the downspout 26.

Each of the vanes 28 is integrated into an inner surface 78 of the first wall 30 and the vanes 28 are spaced apart from each other and are distributed around the opening 58 in the first wall 30. Furthermore, each of the vanes 28 is curved such that each of the vanes 28 follows curvature of the opening 58 and each of the vanes 28 is oriented to slope downwardly into the opening 58. The chute 12 is manufactured in a Northern Hemisphere arrangement having the vanes 28 being oriented to urge the rain 20 and debris 22 to rotate in a clockwise direction when the chute 12 is employed in the Northern Hemisphere. The chute 12 is additionally manufactured in a Southern Hemisphere arrangement having the vanes 28 being oriented to urge the rain 20 and debris 22 to rotate in a counter-clockwise direction when the chute 12 is employed in the Southern Hemisphere.

In use, the chute 12 is mounted to the facia 64 at a location where the downspout 26 intersects the pair of gutters 16. Each of the gutters 16 is attached to a respective one of the entries 14 and the downspout 26 is attached to the exit 24. In this way rain 20 and debris 22 from the gutters 16 are routed through the chute 12 before entering the downspout 26. The chute 12 increases the velocity of the rain 20 and debris 22 as the rain and debris 22 flows through the chute 12 to inhibit the debris 22 from producing a clog in the gutters 16. Furthermore, the vanes 28 impart a rotation into the rain 20 and the debris 22 as the rain 20 and debris 22 passes through the exit 24 and into the downspout 26. In this way the chute 12 inhibits the debris 22 from becoming clogged in the downspout 26. Thus, the gutters 16 and the downspout 26 are facilitated to efficiently drain the rain 20 the debris 22 without becoming clogged as commonly occurs with the current design of gutters and downspouts.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A gutter debris chute assembly to facilitate debris in a gutter to pass through a downspout without becoming lodges in the gutter, said assembly comprising:

a chute having a pair of entries each being attachable to a respective pair of gutters on a building wherein said chute is configured to receive rain and debris from the gutters, said chute having an exit being positioned between said entries, said exit being attachable to a downspout on the building wherein said chute is configured to direct the rain and debris into the downspout, said chute curving downwardly between each of said entries and said exit thereby facilitating said chute to increase the velocity of the rain and debris when the rain and debris moves toward said exit wherein said chute is configured to inhibit the debris from clogging in said chute, said chute having a plurality of vanes each being disposed in said chute, each of said vanes being oriented to surround said exit, each of said vanes being curved thereby urging the rain and debris to flow in a circular direction wherein said vanes are configured to inhibit the debris from clogging in the downspout;

wherein said chute has a first wall and a second wall, said first wall having a top edge and a rear edge, said first wall curving outwardly between said top edge and said rear edge such that said first wall defines a semi-spherical shape;

wherein said second wall being planar having a front surface and a rear surface, said rear edge being attached to said front surface of said second wall such that said rear edge defines a lower threshold of said second wall;

wherein said first wall has an opening extending through said first wall wherein said opening is configured to pass the rain and debris through said opening, said opening being positioned adjacent to said second wall, said opening being aligned with an apex of said first wall; and wherein each of said vanes is curved such that each of said vanes follows a curvature of said opening.

2. The assembly according to claim 1, wherein:

each of said entries has a basal wall extending between a front wall and a rear wall;

said rear wall of each of said entries is integrated into a respective one of a first lateral edge and a second lateral edge of said second wall, said rear wall of each of said entries being offset from said second wall toward said first wall;

said basal wall of each of said entries is integrated into a respective one of a first lateral edge and a second lateral edge of said second wall; and said front wall of each of said entries being integrated into a respective one of said first lateral edge and said second lateral edge of said first wall.

3. The assembly according to claim 1, wherein said second wall has a plurality of holes each extending through said front surface and said back surface of said second wall thereby facilitating each of said holes to accommodate a fastener to fasten said second wall to facia of the building, said holes being arranged into a plurality of columns being spaced apart from each other and being distributed between said first lateral edge and said second lateral edge of said second wall.

4. The assembly according to claim 1, wherein said exit has a plurality of intersecting walls such that said exit has a rectangular shape, each of said intersecting wall has an upper edge and a lower edge, said upper edge of each of said intersecting walls being integrated into said an outer surface of said first wall, said exit being aligned with said opening in said first wall, said opening in said first wall conforming to said upper edge of each of said intersecting walls of said exit, said lower edge of each of said intersecting walls defining an opening into said exit for insertably receiving the downspout.

5. The assembly according to claim 1, wherein each of said vanes is integrated into an inner surface of said first wall, said vanes being spaced apart from each other and being distributed around said opening in said first wall.

6. The assembly according to claim 1, wherein each of said vanes is oriented to slope downwardly into said opening.

7. A gutter debris chute assembly to facilitate debris in a gutter to pass through a downspout without becoming lodges in the gutter, said assembly comprising:

a chute having a pair of entries each being attachable to a respective pair of gutters on a building wherein said chute is configured to receive rain and debris from the gutters, said chute having an exit being positioned between said entries, said exit being attachable to a downspout on the building wherein said chute is configured to direct the rain and debris into the downspout, said chute curving downwardly between each of said entries and said exit thereby facilitating said chute to increase the velocity of the rain and debris when the rain and debris moves toward said exit wherein said chute is configured to inhibit the debris from clogging in said chute, said chute having a plurality of vanes each being disposed in said chute, each of said vanes being oriented to surround said exit, each of said vanes being curved thereby urging the rain and debris to flow in a circular direction wherein said vanes are configured to inhibit the debris from clogging in the downspout, said chute having a first wall and a second wall, said first wall having a top edge and a rear edge, said first wall curving outwardly between said top edge and said rear edge such that said first wall defines a semi-spherical shape, said second wall being planar having a front surface and a rear surface, said rear edge being attached to said front surface of said second wall such that said rear edge defines a lower threshold of said second wall, each of said entries having a basal wall extending between a front wall and a rear wall, said rear wall of each of said entries being integrated into a respective one of a first lateral edge and a second lateral edge of said second wall, said rear wall of each of said entries being offset from said second wall toward said first wall, said basal wall of each of said entries being integrated into a respective one of a first lateral edge and a second lateral edge of said second wall, said front wall of each of said entries being integrated into a respective one of said first lateral edge and said second lateral edge of said first wall, said first wall having an opening extending through said first wall wherein said opening is configured to pass the rain and debris through said opening, said opening being positioned adjacent to said second wall, said opening being aligned with an apex of said first wall, said second wall having a plurality of holes each extending through said front surface and said back surface of said second wall thereby facilitating each of said holes to accommodate a fastener to fasten said second wall to facia of the building, said holes being arranged into a plurality of columns being spaced apart from each other and being distributed between said first lateral edge and said second lateral edge of said second wall, said exit having a plurality of intersecting walls such that said exit has a rectangular shape, each of said intersecting wall having an upper edge and a lower edge, said upper edge of each of said intersecting walls being integrated into said an outer surface of said first wall, said exit being aligned with said opening in said first wall, said opening in said first wall conforming to said upper edge of each of said intersecting walls of said exit, said lower edge of each of said intersecting walls defining an opening into said exit for insertably receiving the downspout, each of said vanes being integrated into an inner surface of said first wall, said vanes being spaced apart from each other and being distributed around said opening in said first wall, each of said vanes being curved such that each of said vanes follows a curvature of said opening, each of said vanes being oriented to slope downwardly into said opening.

* * * * *